US007714809B2

(12) United States Patent
Park

(10) Patent No.: US 7,714,809 B2
(45) Date of Patent: May 11, 2010

(54) PLASMA DISPLAY DEVICE AND DRIVING METHOD THEREOF

(75) Inventor: Seung-Ho Park, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 848 days.

(21) Appl. No.: 11/524,200

(22) Filed: Sep. 21, 2006

(65) Prior Publication Data

US 2007/0080897 A1 Apr. 12, 2007

(30) Foreign Application Priority Data

Sep. 26, 2005 (KR) ..... 10-2005-0089410

(51) Int. Cl.
*G09G 3/28* (2006.01)

(52) U.S. Cl. ..... 345/63; 345/60; 345/66; 345/68; 345/69

(58) Field of Classification Search ..... 345/39, 345/41, 613, 690, 639, 611, 211, 60–69, 345/207, 212, 204; 315/169.4, 169.1; 313/582, 313/584

See application file for complete search history.

(56) References Cited

U.S. PATENT DOCUMENTS 6,331,843 B1 * 12/2001 Kasahara et al. ..... 345/63
6,512,501 B1 * 1/2003 Nagaoka et al. ..... 345/66
6,593,903 B2 * 7/2003 Nakamura et al. ..... 345/60
7,592,977 B2 * 9/2009 Park ..... 345/63
2002/0018031 A1 * 2/2002 Nakamura et al. ..... 345/60
2002/0036650 A1 * 3/2002 Kasahara et al. ..... 345/639
2002/0126139 A1 9/2002 Kuriyama et al.
2003/0048285 A1 * 3/2003 Okuzawa et al. ..... 345/690
2003/0122743 A1 7/2003 Suzuki
2004/0183755 A1 * 9/2004 Kim ..... 345/63
2005/0007311 A1 * 1/2005 Choi ..... 345/60
2005/0024390 A1 * 2/2005 Kimura ..... 345/690
2005/0052363 A1 * 3/2005 Jeong ..... 345/63
2005/0062690 A1 * 3/2005 Jeong ..... 345/63
2005/0243028 A1 * 11/2005 Usui et al. ..... 345/63
2006/0012547 A1 * 1/2006 Chang ..... 345/63

(Continued)

FOREIGN PATENT DOCUMENTS

CN 1246952 3/2000

(Continued)

OTHER PUBLICATIONS

Search Report issued in European Patent No. 06121058.9 on Feb. 14, 2007.

*Primary Examiner*—Prabodh M Dharia
(74) *Attorney, Agent, or Firm*—Stein McEwen, LLP

(57) ABSTRACT

A plasma display device and driving method thereof has a peak value of one frame is detected and then converted. A grayscale or a grayscale value is converted according to an original peak value and a converted peak value, and a total number of sustain pulses applied to the one frame is reset such that a brightness corresponding to the converted grayscale or grayscale value is set to be equal to a brightness corresponding to the original grayscale or grayscale value. In such a manner, the numbers of on-subfields and useable subfields corresponding to the grayscale of the input video signal are increased, so that the discharge characteristics are enhanced and the false contour is reduced.

4 Claims, 5 Drawing Sheets

U.S. PATENT DOCUMENTS

| | | | | |
|---|---|---|---|---|
| 2006/0097962 | A1* | 5/2006 | Yang | 345/63 |
| 2006/0152444 | A1* | 7/2006 | Park | 345/63 |
| 2006/0214886 | A1* | 9/2006 | Takeuchi et al. | 345/63 |
| 2007/0024534 | A1* | 2/2007 | Park | 345/63 |
| 2007/0103398 | A1* | 5/2007 | Correa et al. | 345/63 |
| 2007/0103399 | A1* | 5/2007 | Correa et al. | 345/63 |
| 2008/0129658 | A1* | 6/2008 | Baek | 345/63 |

FOREIGN PATENT DOCUMENTS

| | | | |
|---|---|---|---|
| CN | 1601590 | | 3/2005 |
| EP | 1 014 330 | A2 | 6/2000 |
| EP | 1 014 330 | A3 | 11/2000 |
| EP | 1 139 322 | A2 | 10/2001 |
| EP | 1 139 322 | A3 | 11/2002 |
| EP | 1 519 355 | A1 * | 3/2005 |
| EP | 1 748 409 | A1 | 1/2007 |
| JP | 11-065519 | | 3/1999 |
| JP | 2003-177697 | | 6/2003 |

* cited by examiner

FIG.3

| APC Level | Sustain discharge pulse number determiner | Sustain discharge pulse number determiner |
|---|---|---|
| 0 | sus_apc0 | sus_apc0' |
| 1 | sus_apc1 | sus_apc1' |
| 2 | sus_apc2 | sus_apc2' |
| ⋮ | ⋮ | ⋮ |
| 254 | sus_apc254 | sus_apc254' |
| 255 | sus_apc255 | sus_apc255' |

FIG.4

| Peak value(Lpeak) | Converted peak value(Lpeak') |
|---|---|
| 0 | peak_0 |
| 1 | peak_1 |
| 2 | peak_2 |
| ... | ... |
| 127 | peak_127(=201) |
| ... | ... |
| 254 | peak_254 |
| 255 | peak_255 |

FIG.6

| Subfield | SF1 | SF2 | SF3 | SF4 | SF5 | SF6 | SF7 | SF8 | SF9 | SF10 |
|---|---|---|---|---|---|---|---|---|---|---|
| Weight vlaue / Grayscale | 1 | 2 | 4 | 8 | 16 | 32 | 42 | 44 | 52 | 54 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| 4 | × | × | ○ | × | × | × | × | × | × | × |
| ... | ... | ... | ... | ... | ... | ... | ... | ... | ... | ... |
| 127 | ○ | × | × | ○ | × | ○ | ○ | ○ | × | × |
| 128 | × | ○ | × | ○ | × | ○ | ○ | ○ | × | × |
| ... | ... | ... | ... | ... | ... | ... | ... | ... | ... | ... |
| 201 | ○ | ○ | ○ | ○ | ○ | ○ | ○ | ○ | ○ | × |
| ... | ... | ... | ... | ... | ... | ... | ... | ... | ... | ... |
| 254 | × | ○ | ○ | ○ | ○ | ○ | ○ | ○ | ○ | ○ |
| 255 | ○ | ○ | ○ | ○ | ○ | ○ | ○ | ○ | ○ | ○ |

I

II

Lpeak

Lpeak'

PLASMA DISPLAY DEVICE AND DRIVING METHOD THEREOF

CROSS-REFERENCE TO RELATED APPLICATION

This application claims the benefit of Korean Application No. 2005-89410, filed Sep. 26, 2005 in the Korean Intellectual Property Office, the disclosure of which is incorporated herein by reference.

BACKGROUND OF THE INVENTION

1. Field of the Invention

Aspects of the present invention relate to a plasma display device and a driving method thereof. Aspects of the present invention relate to a plasma display device and a driving method where input grayscales are converted and the number of on-subfields and useable subfields corresponding to the grayscales of input videos are increased to enhance discharge characteristics and reduce false contours.

2. Description of the Related Art

A plasma display device is a display device that uses plasma generated by a gas discharge to display characters or images. In a plasma display device, a video signal of one frame is divided into a plurality of subfields respectively having a weight. Gray scales are expressed by a combination of the subfields of different weights. Each of the subfields include a reset period, an address period, and a sustain period. The reset period is for initializing the states of each discharge cell so as to facilitate an addressing operation of the discharge cell or cells. The address period is for selecting turn-on/turn-off of the discharge cells (i.e., discharge cells to be turned on or off) and accumulating wall charges in the discharge cells (i.e., the addressed discharge cells) that are in the turn-on state. The sustain period is for causing a discharge for displaying of an image using the addressed discharge cells.

However, when an input video signal data of the one frame is divided into a plurality of subfields and grayscales are displayed according to the on/off of the subfields as describe above, a false contour may be generated due to human vision properties. That is, when a moving image is displayed, a false contour phenomenon may occur in which a grayscale that is different from an actual one is perceived by human eyes because of the vision properties of the human eyes that follow the movement of the image.

In addition, when the number of the turned-on subfields is small when the grayscales are displayed according to the on/off of the respective subfields, a small amount of priming particles is generated. Accordingly, a discharge may not be sufficiently generated.

SUMMARY OF THE INVENTION

Aspects of the present invention have been made in an effort to provide a plasma display device and a driving method thereof having advantages of reducing a false contour and enhancing discharge characteristics.

In an aspect of the present invention, a driving method of a plasma display device to divide an input video signal of one frame into a plurality of subfields includes detecting a first peak value, being the highest grayscale value among grayscale values of the video signal of the one frame; converting the first peak value into a second peak value to increase a number of useable subfields; converting the grayscale values of the video signal of the one frame according to the first and second peak value; and applying the converted grayscale values to the plasma display device.

A number of the first subfields for expressing the second peak value may be greater than a number of the second subfields for expressing the first peak value, and the second peak value may have a grayscale when all the first subfields are turned on.

The same number of sustain discharge pulses may be allocated for the original and converted grayscale values.

In addition, the driving method may include detecting a load ratio of the video signal of one frame, and determining a first sustain discharge pulse number and applying the first sustain discharge pulse number to the plasma display device, the first sustain discharge pulse number being a total number of the sustain discharge pulses applied to the one frame according to the load ratio and the first and second peak values.

In aspects of the present invention, a driving method of a plasma display device to divide an input video signal of one or more frames into a plurality of subfields includes converting and expressing a first grayscale value among video signals of a first frame into a second grayscale value when a first peak value is the highest among the video signals of the first frame, the first grayscale value being lower than the first peak value; and converting and expressing a third grayscale value among video signals of a second frame into a fourth grayscale when a second peak value is the highest among the video signals of the second frame, the third grayscale value being same as the first grayscale value, wherein output subfields data of the second and fourth grayscales are different when the first peak value is different from the second peak value. The fourth grayscale may be lower than the second grayscale when the second peak value has a higher grayscale value than the first peak value, and the first and second peak values may be converted in a same grayscale.

The same brightness may be substantially expressed by the second and fourth grayscale values when the first and second frames have the same load ratio.

In aspects of the present invention, a plasma display device includes a plasma display panel (PDP) having a plurality of discharge cells; a controller to control the PDP by dividing a plurality of subfields from input video signals of one frame; and a driver to drive the PDP according to a control signal of the controller, wherein the controller detects a first peak value which is the highest grayscale value among grayscale values of the input video signals of the one frame, converts the first peak into a second peak value to increase a number of useable subfields, converts the grayscale of the video signal of the one frame according to the first and second peak values, and applies the converted grayscale values to the plasma display device.

In addition, the same number of sustain discharge pulses is allocated for the original and converted grayscale values.

In addition, the controller may include a peak value converter to convert the first peak value into the second peak value; an automatic power controller to detect a load ratio of the video signal of the one frame; a first sustain discharge pulse number determiner to detect a first sustain discharge pulse number, being a total number of the sustain discharge pulses applied to the one frame according to the load ratio; a grayscale value converter to convert the grayscale of the video signal of the one frame according to the first and second peak values; and a second sustain discharge pulse number determiner to determine the second sustain discharge pulse number, being a total number of the sustain discharge pulses finally applied to the PDP and to the one frame according to the first peak value, the second peak value, and the first sustain pulse number.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which:

FIG. 3 shows the relationship between the number of first and second sustain discharge pulses and automatic power control (APC) levels, the number of first sustain discharge pulses being determined according to the APC levels and the number of second sustain discharge pulses determined according to the first and second peak values according to an aspect of the present invention.

FIG. 4 schematically shows a peak value Lpeak and a corresponding converted peak value Lpeak' according to an aspect of the present invention.

FIG. 6 shows the increased number of on-subfields when grayscales or grayscale values are changed according to a peak value Lpeak and a converted peak value Lpeak' according to an aspect of the present invention.

DETAILED DESCRIPTION OF THE EMBODIMENTS

Figure 1:
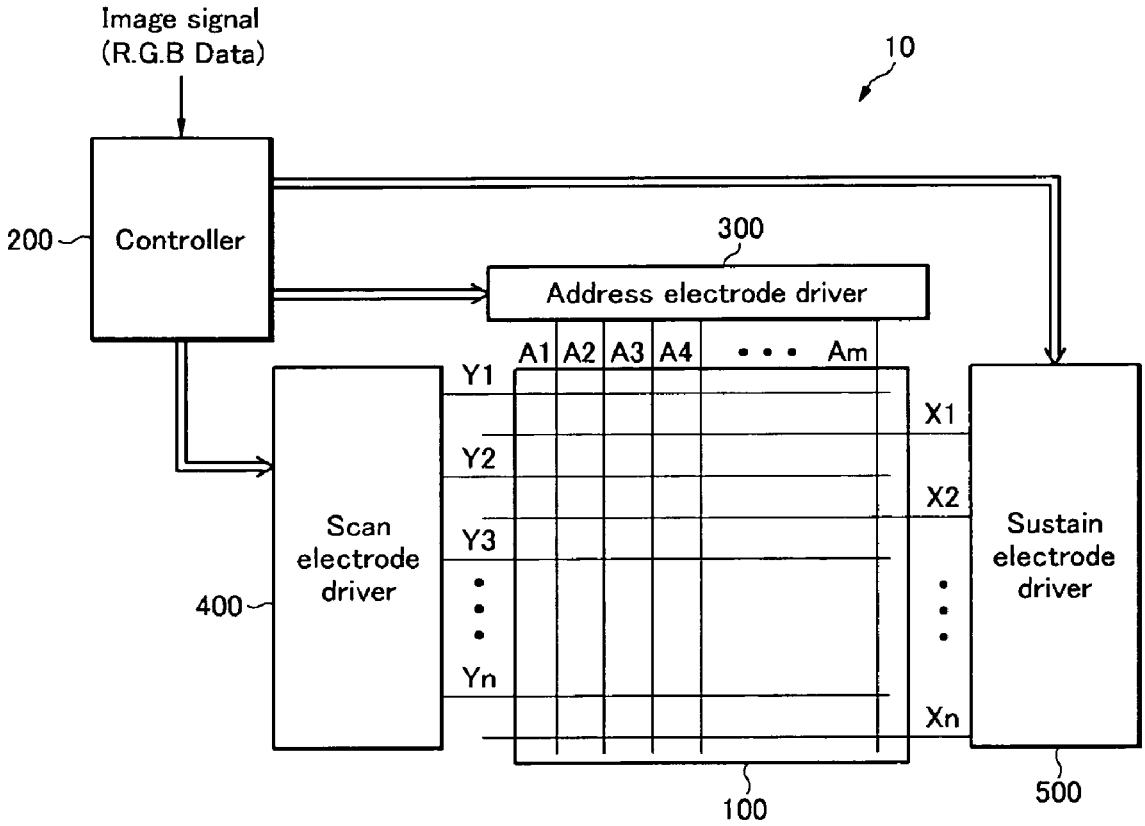
FIG. 1 schematically shows a top plan view of a plasma display device according to an aspect of the present invention.

Reference will now be made in detail to the aspects of the present invention, examples of which are illustrated in the accompanying drawings, wherein like reference numerals refer to the like elements throughout. The aspects are described below in order to explain the present invention by referring to the figures.

In the following detailed description, various aspects of the present invention have been shown and described, simply by way of illustration. As those skilled in the art would realize, the described aspects may be modified in various different ways, all without departing from the spirit or scope of the present invention. Accordingly, the drawings and description are to be regarded as illustrative in nature and not restrictive.

In addition, a "sustain pulse" is referred to as a waveform applied to an electrode so as to generate a sustain discharge during a sustain period. Accordingly, various waveforms may be used, such as a pulse, a square wave, an increasing wave, etc. In addition, a number of the sustain discharge pulses is used to generate a corresponding number of sustain discharges during the sustain period because a single sustain discharge pulse usually generates a single sustain discharge during the sustain period.

FIG. 1 schematically shows a top plan view of a plasma display device according to aspect of the present invention.

As shown in FIG. 1, a plasma display device 10 according to an aspect of the present invention includes a PDP 100, a controller 200, an address electrode driver 300, a scan electrode driver 400, and a sustain electrode driver 500.

The PDP 100 includes a plurality of address electrodes Al to Am arranged in a column direction, and a plurality of scan and sustain electrodes, respectively, Y1 to Yn and X1 to Xn arranged in a row direction, in pairs. Generally, the sustain electrodes X1 to Xn are formed to correspond to the respective scan electrodes Y1 to Yn, and respective ends thereof are coupled to one another.

In addition, the PDP 100 includes one substrate (not shown) having the sustain and scan electrodes X1 to Xn and Y1 to Yn formed thereon, and the other substrate (not shown) having the address electrodes A1 to Am formed thereon. The two substrates are disposed to face each other, and have a discharge space interposed therebetween such that the address electrodes A1 to Am perpendicularly cross both the scan and sustain electrodes Y1 to Yn and X1 to Xn. A discharge cell is formed in a portion of the discharge space formed at an area where the address electrodes Al to Am cross the sustain and scan electrodes X1 to Xn and Y1 to Yn. This structure of the PDP 100 shown in FIG. 1 is an example structure for a PDP. Accordingly, the invention is not limited to only the structure shown in FIG. 1 and other panel structures, to which the various driving waveforms described below can be applied, can be used in various aspects of the present invention.

The address electrode driver 300 receives the address electrode driving control signal from the controller 200, and applies a display data signal for selecting discharge cells to be discharged to each address electrodes A1 to Am. The sustain electrode driver 500 receives the sustain electrode driving control signal from the controller 200, and applies a driving voltage to the sustain electrodes X1 to Xn. The scan electrode driver 400 receives the scan electrode driving control signal from the controller 200, and applies the driving voltage to the scan electrodes Y1 to Yn.

The controller 200 receives external video signals R, G, and B data (i.e., red, green, and blue data) and outputs an address electrode driving control signal, a sustain electrode driving control signal, and a scan electrode driving control signal. The controller 200 divides one frame into a plurality of subfields, which are subject to time-division control, and each subfield is divided into a reset period, an address period, and a sustain period. In order to reduce a false contour and enhance discharge characteristics, the controller 200 according to an aspect of the present invention converts the input video signals R, G, and B data according to a peak value of one frame, and changes a total number of the sustain discharge pulses applied to the one frame according to a load ratio and the peak value of the one frame, as discussed below.

A method for reducing a false contour and enhancing discharge characteristics using a controller 200 of a plasma display device 10 according to aspects of the present invention will be described with reference to FIG. 2 through FIG. 6.

Figure 2:
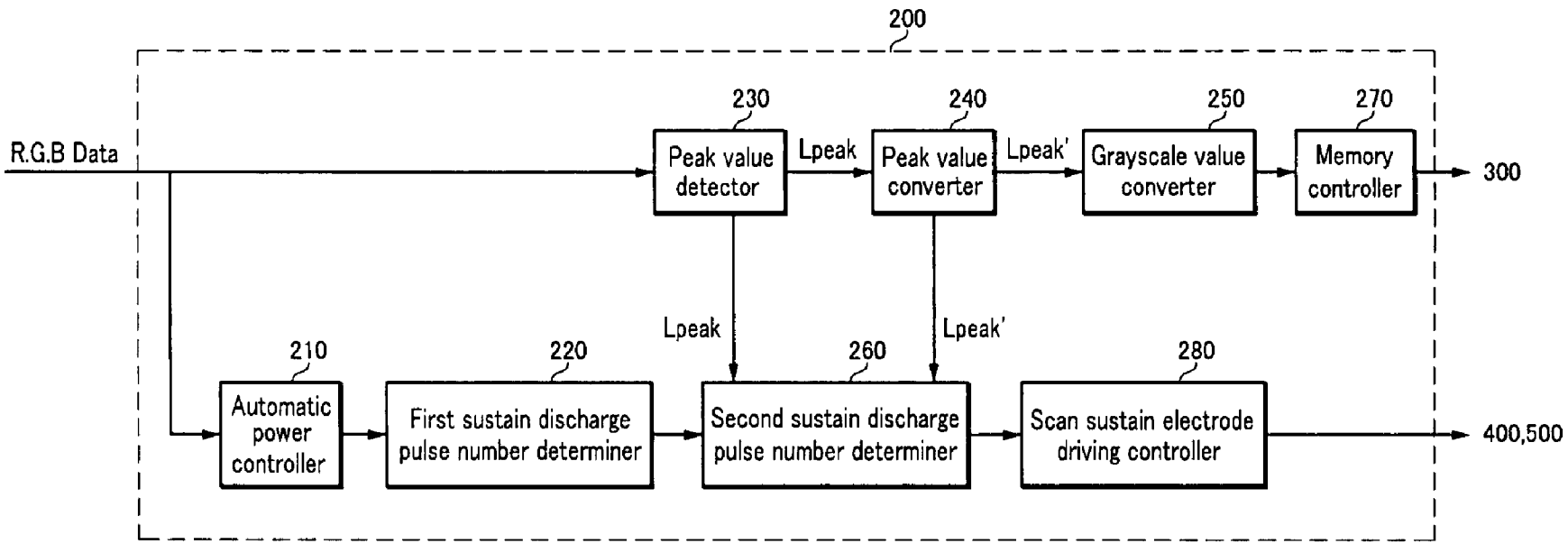
FIG. 2 schematically shows a block diagram of a controller of the plasma display device of FIG. 1.
Figure 5:
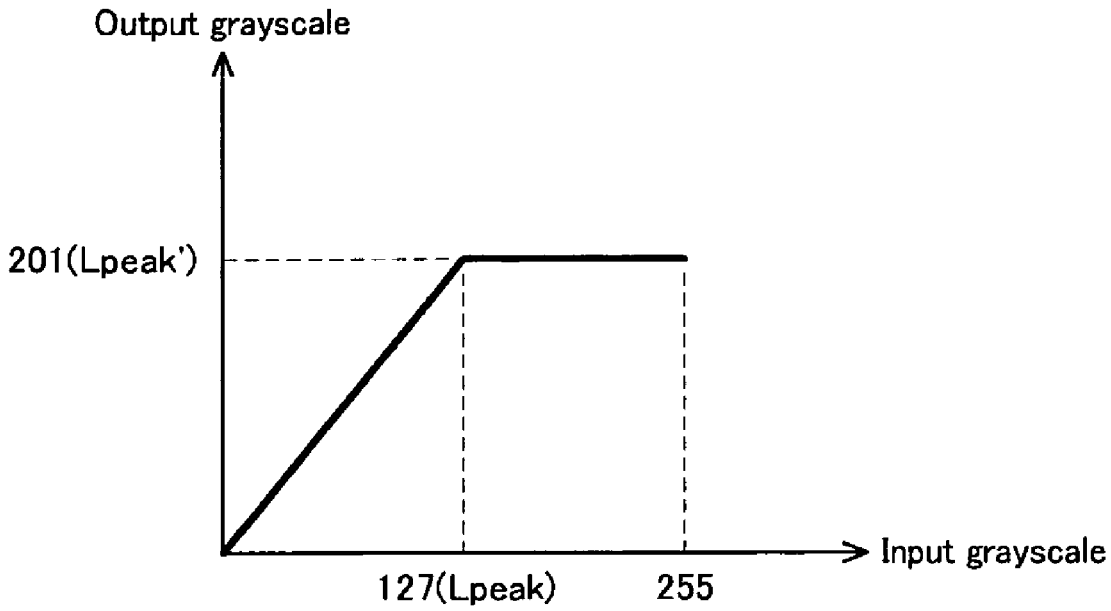
FIG. 5 schematically shows a graph showing the change in a grayscale value according to a peak value Lpeak and a converted peak value Lpeak' according to an aspect of the present invention.

FIG. 2 schematically shows a block diagram of a controller 200 of a plasma display device 10 according to FIG. 1. FIG. 3 shows the relationship between the number of first sustain discharge pulses, the number of second sustain discharge pulses, and APC levels, the number of first sustain discharge pulses being determined according to the APC levels, and the number of second sustain discharge pulses being determined according to peak values, according to an aspect of the present invention. FIG. 4 schematically shows a peak value Lpeak and a corresponding converted peak value Lpeak', according to an aspect of the present invention. FIG. 5 schematically shows a graph showing the change in a grayscale value according to a peak value Lpeak and a converted peak value Lpeak' according to an aspect of the present invention. FIG. 6 shows the increased number of on-subfields when grayscales or grayscale values are changed according to a peak value Lpeak and a converted peak value Lpeak', according to an aspect of the present invention.

As shown in FIG. 2, the controller 200 of the plasma display device 10 according to FIG. 1 includes an automatic power controller 210, a first sustain discharge pulse number determiner 220, a peak value detector 230, a peak value converter 240, a grayscale value converter 250, a second sustain discharge pulse number determiner 260, a memory controller 270, and a scan sustain electrode driving controller 280.

First, the automatic power controller 210 calculates an average signal level (hereinafter, referred to as an 'ASL' level) for the respective frames of the input video signals R, G, and B data, and detects an automatic power control level (hereinafter, referred to as an 'APC' level) according to the calculated average signal level (ASL).

An average signal level (ASL) for the respective frames is calculated using Equation 1.

$$ASL = \sum_{x=1}^{N}\sum_{y=1}^{M}\frac{R_{x,y}+G_{x,y}+B_{x,y}}{3\times N\times M} \quad \text{(Equation 1)}$$

In Equation 1, Rx,y, Gx,y, and Bx,y are respectively given as R, G, and B grayscale values in a discharge cell at a position (x, y), and N and M are respectively given as vertical and horizontal sizes of the one frame.

The automatic power controller 210 detects (or looks up) the APC levels corresponding to the ASL calculated using Equation 1. In various aspects, the APC levels have been previously established and delineated into the plurality of levels 0 to 255 corresponding to the ASL. FIG. 3 shows the APC levels that are expressed (delineated) into a plurality of levels ranging from 0 to 255. However, such delineation is but one example. Accordingly, it should be understood that the respective delineation of the APC levels may be varied. In various aspects, a method of detecting whether the input video signal data (R, G, and B data) generally have higher power consumption is closely related to a detecting method of a load ratio. According to an aspect of the present invention, the load ratio is detected by detecting the ASL. However, it should be understood that data of subfields may be used to detect the load ratio.

The first sustain discharge pulse number determiner 220 receives the APC level information from the automatic power controller 210, and determines the number of first sustain discharge pulses corresponding to the received APC level. The number of the first sustain discharge pulses may be set to correspond to the received APC level. The number indicates the total number of the sustain discharge pulses that should be applied to the one frame. In FIG. 3, the first sustain discharge pulse number corresponding to the respective APC levels are expressed as symbols, such as sus_apc0, sus_apc1, sus_apc2 . . . sus_apc254, and sus_apc255. For each of the respective APC levels, an actual number or a numerical value is associated with it.

When the APC level is set to be a higher level corresponding to the input video signal having a higher load ratio (i.e., for a pattern of higher power consumption), the first sustain discharge pulse number is set to be smaller for the higher APC level such that the power consumption is set to be below a predetermined level. That is, in FIG. 3, the first sustain discharge pulse number is set to be smaller as it goes from sus_apc0 to sus_apc255.

The above is only one example of how the automatic power controller 210 determines the APC levels from the input video signal data R, G, and B Data and how the first sustain discharge pulse number determiner 220 determines the first sustain discharge pulse number corresponding to the APC levels. Accordingly, the automatic power controller 210 need not detect the APC levels corresponding to the load ratio, but may detect only the load ratio and transmit information corresponding to the load ratio directly to the first sustain discharge pulse number determiner 220. Accordingly, the first sustain discharge pulse number determiner 220 may determine the first sustain discharge pulse number from the information corresponding to the load ratio in other aspects of the present invention.

The peak value detector 230 detects a peak value Lpeak, that is, the highest grayscale value for the respective frames from among the input video signal data R, G, and B data. That is, the peak value detector 230 detects the highest grayscale value from among the video signal data of the one frame. A method of detecting the peak value (highest grayscale value) of the one frame is understood by a person of ordinary skill in the art, and will not be described in further detail.

The peak value converter 240 receives the peak value (highest grayscale value) Lpeak from the peak value detector 230, and converts the peak value Lpeak so as to increase the number of on-subfields and useable subfields of the input image signal data. Hereinafter, a peak value converted by the peak value converter 240 is referred to as a converted peak value Lpeak'.

The peak value converter 240 sets the converted peak value Lpeak' to which uses (or is expressed by) more subfields than those used to express the input peak value Lpeak, and turns on all or at least more of the useable subfields.

As shown in FIG. 4, the peak value converter 240 has the converted peak values Lpeak' corresponding to the respective input peak values Lpeak in a predetermined lookup table, which may be updated. In FIG. 4, the converted peak values Lpeak' corresponding to the respective input peak values Lpeak are expressed as a peak_0, peak_1 . . . , peak_255, each having an associated value. For example, in one case, the peak value Lpeak may be given as 127. Referring to FIG. 6, up to the eighth subfield SF8, that is, eight subfields are useable to express the Lpeak of 127. However, only five subfields are used (or turn-on) to express Lpeak of 127 (i.e., SF1, SF4, SF6, SF7, and SF8, each having a weight value of 1, 8, 32, 42, and 44, respectively). When Lpeak of 127 is converted to Lpeak' of 201, more of the subfields are useable to express the Lpeak' of 201 and more of the subfields are used (or put in a turn-on state). Accordingly, a converted peak value peak_127 having a grayscale value of 201 may use nine subfields (that is, useable) which is more than the eight subfields used to express the Lpeak value of 127. Accordingly, all of the useable subfields are turned on up to the ninth subfield SF9 (which are SF1, SF2, SF3, SF4, SF5, SF6, SF7, SF8, and SF9, having a weight value of 1, 2, 4, 8, 16, 32, 42, 44, and 52, respectively).

In other aspects, when the peak value Lpeak is given as 127, the converted peak value peak_127 may not be set as 201, but may be set as 255, such that more of the subfields are used, and more of the useable subfields are turned on. Also, when the peak value Lpeak is 254 and uses (or turn-on) all of the useable number of subfields available to Lpeak of 254, the number of useable subfields for the Lpeak of 254 may not be further increased. Accordingly, the converted peak value peak_254 is set as the highest grayscale value of 255 so as to increase the number of the turn-on subfields.

In various aspects of the present invention, and as exemplified by FIG. 6, higher weight subfields may be subdivided into two or more subfields, or one or more higher weight subfields may have their weight values redistributed among greater number of subfields. For example, in a related art, the subfield SF7 may have a weight of 64 and the subfield SF8 may have a weight of 128. In the aspect shown in FIG. 6, the total weight of subfields SF7 and SF8 are distributed over SF7, SF8, SF9, and SF10, having weight values of 42, 44, 52, and 54, respectively. Accordingly, by increasing the number of subfields, particularly in the higher end of the weight values, the abrupt change in the weight values between subfields is reduced.

The grayscale value converter 250 receives the peak value (Lpeak) and the converted peak value Lpeak' from the peak value converter 240, and converts the corresponding grayscale value of the Lpeak so as to increase the number of on-subfields (turn-on subfields) and useable subfields into the corresponding grayscale value of the Lpeak'. The peak value Lpeak being transmitted from the peak value converter 240 is but one aspect of the present invention. Accordingly, in other aspects of the present invention, the grayscale value converter 250 may receive the peak value Lpeak directly from the peak value detector 230.

As shown in FIG. 5, in any one frame, the grayscale value converter 250 receives the peak value Lpeak and the converted peak value Lpeak' and converts the grayscale value or values of the peak value into a predetermined value according to the peak value Lpeak and the converted peak value Lpeak'. In FIG. 5, the input grayscale value indicates a grayscale value that is not converted by the grayscale value converter 250, and the output grayscale value indicates a grayscale value that is converted by the converter 250. The grayscale value converter 250 converts the input grayscale value corresponding to the peak value Lpeak. As a result, the output grayscale value is given by Equation 2.

$$\text{Output grayscale value} = Lpeak'/Lpeak \times \text{Input grayscale value} \quad \text{(Equation 2)}$$

In Equation 2, Lpeak is the peak value detected by the peak value detector 230, and Lpeak' is the peak value detected by the peak value converter 240. As such, when the grayscale value converter 250 converts the input grayscale using Equation 2, the numbers of the on-subfields and the useable subfields corresponding to the converted grayscales are increased as opposed to the pre-converted input grayscale as shown in FIG. 6. In FIG. 6, for better understanding and ease of description, the converted value Lpeak' is assumed to be 201 corresponding to the peak value Lpeak, which is given as 127. In FIG. 6, a weight value arrangement is given as {1 for SF1, 2 for SF2, 4 for SF3, 8 for SF4, 16 for SF5, 32 for SF6, 42 for SF7, 44 for SF8, 52 for SF9, 54 for SF10}. The grayscale value converter 250 converts the grayscale value 127 into the converted peak value Lpeak', that is, 201. When the input grayscale values are below 128, the input grayscale values are converted in accordance with Equation 2 to output an output grayscale value. A range of the useable grayscale values is expanded from region I to region II. Accordingly, the numbers of the on-subfields and the useable subfields are increased corresponding to the increase in the possible output grayscale values (i.e., the converted grayscale values) of the grayscale value converter 240 as compared to the input grayscale value.

However, when the grayscale value converter 240 converts the input grayscale value into a higher output grayscale value, the brightness corresponding to the original grayscale value is not correctly expressed. In order to compensate the brightness according to such a grayscale conversion, a second sustain discharge pulse number determiner 260 described below will reset the total number of the sustain discharge pulses applied to the one frame.

The second sustain discharge pulse number determiner 260 resets the total number of the sustain discharge pulses applied to the one frame according to the peak value Lpeak and the converted peak value Lpeak' respectively transmitted from the peak value detector 230 and peak value converter 240 so as to correct the brightness corresponding to the original grayscale which will not be expressed because the grayscale values are changed by the grayscale value converter 250. That is, the second sustain discharge pulse number determiner 260 receives the peak value Lpeak and the converted peak value Lpeak' respectively from the peak value detector 230 and the peak value converter 240 and the first sustain discharge pulse number from the first sustain discharge pulse number determiner 220, changes the first sustain discharge pulse number according to the peak value Lpeak and the converted peak value Lpeak', and finally determines the second sustain discharge pulse number (i.e., the discharge pulse number that corresponds to the converted peak value or the converted grayscales value). Accordingly, the second sustain discharge pulse number is given by changing the first sustain discharge pulse number determined by the first sustain discharge pulse number determiner 220 and indicates the total number of the sustain discharge pulses that will be finally applied to the one frame after the various conversions. In FIG. 3, the second sustain discharge pulse number is expressed as symbols sus_apc0', sus_apc1', sus_apc2' . . . sus_apc254', and sus_apc255', however, they are actually numbers.

In order to compensate for the brightness difference between the converted and original grayscales, the second sustain discharge pulse number determiner 260 uses Equation 3 to determine the second sustain discharge pulse number according to the peak value Lpeak and the converted peak value Lpeak'.

$$\text{sus_apc}' = \frac{\text{sus_apc}' \times Lpeak}{Lpeak'} \quad \text{(Equation 3)}$$

In Equation 3, sus_apc is the first sustain discharge pulse number, and sus_apc' is the second sustain discharge pulse number. In addition, Lpeak is the peak value detected by the peak value detector 230, and Lpeak' is the highest grayscale value among the useable grayscales.

The following is a description of how to express the brightness of the original grayscales when the second sustain discharge pulse number determiner 260 finally determines the total number of the sustain discharge pulses to be applied to the one frame using Equation 3.

First, for the one frame, the peak value Lpeak, the APC level (e.g., 200), the first sustain discharge pulse number sus_apc200 corresponding to the APC level 200, and the converted peak value Lpeak' are respectively given as 127, 200, 900, and 201, for example.

The sustain discharge pulse number allocated to the original grayscale gray level 127 is given as 900×(127/255) =448.2, that is, 448 and the brightness corresponding to the sustain discharge pulse number is expressed. In addition, the grayscale value converted by the grayscale value converter 250 is applied to Equation 2, and accordingly, the grayscale value is converted into {201(=Lpeak')/127(=Lpeak)}×127

(input grayscale)=201. In addition, the grayscale value is applied to Equation 3, and accordingly, the second sustain discharge pulse sus_apc200' is determined into {900(=sus_apc200)/201(=Lpeak')}×127(=Lpeak)=568.6, that is, 569. Meanwhile, since the Lpeak of 127 is converted to the Lpeak' of 201, the sustain discharge pulse number allocated to the converted grayscale value 201 will be 569 (=the second sustain discharge pulse number)×(201/255)=448.5, that is, 449. Therefore, although the grayscale value converter 250 converts the grayscale value, almost the same sustain discharge pulse number is allocated for the original grayscale value 127 and the converted grayscale value 201, and considering a rounding operation, the same brightness is expressed.

The memory controller 270 generates subfield data corresponding to the converted grayscale value and rearranges the generated subfield data in address data. The memory controller 270 transmits the address electrode driving control signal to the address electrode driver 300 such that the address data are applied to the address electrodes A1 to Am. The subfield data indicates whether the respective subfields are turned on corresponding to the respective grayscales (or grayscale values).

In addition, the scan sustain electrode driving controller 280 outputs control signals to the scan electrode driver 400 and the sustain electrode driver 500 such that the second sustain discharge pulse number transmitted from the second sustain discharge pulse number determiner 260 are applied to the scan electrodes Y1 to Yn and the sustain electrodes X1 to Xn by the scan electrode driver 400 and the sustain electrode driver 500, respectively.

According to an aspect of the present invention, the grayscale of the input video signal is converted so as to increase the number of on-subfields and useable subfields. As the number of on-subfields (turn-on subfields) and useable subfield increases, the priming particles are increased to thereby enhance discharge characteristics of the discharge cells. In addition, as the number of the turn-on subfields (on-subfields) and the useable subfields increases, the difference of the on/off subfields between the respective grayscales (or grayscale values) is reduced thereby reducing a false contour. Also, even with the increased number of on-subfields and the useable subfields, the brightness is maintained.

As described above, according to an exemplary embodiment of the present invention, when the input grayscales are converted such that the number of on-subfields and useable subfields corresponding to the grayscale of the input video signal are increased, the discharge characteristics can be enhanced and the false contour can be reduced.

Although a few aspects of the present invention have been shown and described, it would be appreciated by those skilled in the art that changes may be made in these aspects without departing from the principles and spirit of the invention, the scope of which is defined in the claims and their equivalents.

What is claimed is:

1. A driving method of a plasma display device to divide an input video signal of one or more frames into a plurality of subfields, comprising:

converting and expressing a first grayscale value among video signals of a first frame into a second grayscale value when a first peak value is the highest among the video signals of the first frame, the first grayscale value being lower than the first peak value; and converting and expressing a third grayscale value among video signals of a second frame into a fourth grayscale value when a second peak value is the highest among the video signals of the second frame, the third grayscale value being same as the first grayscale value, wherein output subfield data of the second and fourth grayscale values are different when the first peak value is different from the second peak value.

2. The driving method of claim 1, wherein the fourth grayscale value is lower than the second grayscale value when the second peak value has a higher grayscale value than the first peak value and the first and second peak values are converted in a same grayscale.

3. The driving method of claim 1, wherein the same brightness is substantially expressed by the second and fourth grayscale values when the first and second frames have the same load ratio.

4. The driving method of claim 1, wherein the second peak value has a higher grayscale value than the first peak value, the first and second peak values are converted into a same grayscale, the first and second frames have the same load ratio, and the total sustain pulse number applied to the second frame is greater than that applied to the first frame.

* * * * *